US009085079B2

(12) United States Patent
Manohar

(10) Patent No.: US 9,085,079 B2
(45) Date of Patent: Jul. 21, 2015

(54) MARKING GAUGE

(75) Inventor: Raghunath Manohar, Manipal (IN)

(73) Assignee: Manipal University (IN)

( * ) Notice: Subject to any disclaimer, the term of this patent is extended or adjusted under 35 U.S.C. 154(b) by 192 days.

(21) Appl. No.: 13/579,468

(22) PCT Filed: Jan. 6, 2011

(86) PCT No.: PCT/IB2011/050047

§ 371 (c)(1),
(2), (4) Date: Aug. 16, 2012

(87) PCT Pub. No.: WO2012/069933

PCT Pub. Date: May 31, 2012

(65) Prior Publication Data

US 2012/0311877 A1 Dec. 13, 2012

(30) Foreign Application Priority Data

Nov. 23, 2010 (IN) ..... 3533/CHE/2010

(51) Int. Cl.
*B25H 7/04* (2006.01)

(52) U.S. Cl.
CPC ..... *B25H 7/04* (2013.01)

(58) Field of Classification Search
CPC ..... B25H 7/04; B25H 7/02; B25H 7/00; B44D 3/225; B26B 29/06; B43L 13/02; B43L 13/04; C03B 33/027; C03B 33/10; C03B 33/12; C03B 33/03; A23G 9/285; B41G 3/00
USPC ..... 33/42, 44, 32.1, 32.3
See application file for complete search history.

(56) References Cited

U.S. PATENT DOCUMENTS

| | | | | | |
|---|---|---|---|---|---|
| 230,127 | A | * | 7/1880 | Goodwin | 33/44 |
| 266,646 | A | * | 10/1882 | Rossman | 33/18.1 |
| 762,673 | A | * | 6/1904 | Arnold | 33/44 |
| 2,134,069 | A | * | 10/1938 | Zimmerman | 408/93 |
| 2,525,186 | A | | 10/1950 | Sosdian | |
| 2,557,699 | A | * | 6/1951 | Silver | 33/18.1 |
| 3,015,889 | A | * | 1/1962 | Godman | 33/27.03 |
| 3,281,942 | A | * | 11/1966 | Preuit | 33/457 |
| 3,491,448 | A | * | 1/1970 | Quinton et al. | 33/27.01 |
| 3,664,025 | A | * | 5/1972 | Barto | 33/27.03 |
| 3,775,853 | A | * | 12/1973 | Doret et al. | 33/27.03 |

(Continued)

OTHER PUBLICATIONS

Marking Gauge, http://en.wikipedia.org/wiki/Marking_gauge, retrieved on Dec. 4, 2012, 1 page.

(Continued)

*Primary Examiner* — Yaritza Guadalupe-McCall
(74) *Attorney, Agent, or Firm* — Moritt Hock & Hamroff LLP; Steven S. Rubin, Esq.

(57) ABSTRACT

Technologies are generally described for a marking gauge. In some examples, the marking gauge includes a scribing bar and a marking pin disposed at a fixed location in the scribing bar. A bolt may extend through a stock and the scribing bar. A nut may be in contact with the scribing bar and engaged with the bolt. The nut and the bolt may be effective to fasten the stock to the scribing bar. The scribing bar may include walls defining a longitudinally extending slot and the mortise pin may extend through the longitudinally extending slot. A pointed end of the mortise pin and of the marking pin may be adjustable with respect to the scribing bar.

19 Claims, 2 Drawing Sheets

(56) References Cited

U.S. PATENT DOCUMENTS

| | | | | |
|---|---|---|---|---|
| 3,871,100 | A * | 3/1975 | Hildebrandt | 33/42 |
| 4,595,040 | A | 6/1986 | Glisman | |
| 4,809,439 | A * | 3/1989 | Burns | 33/42 |
| 4,903,409 | A * | 2/1990 | Kaplan et al. | 33/42 |
| D313,190 | S | 12/1990 | Economaki | |
| 5,651,184 | A * | 7/1997 | Tutty | 33/21.1 |
| 6,804,890 | B1 * | 10/2004 | Kennedy, Sr. | 33/21.3 |
| 7,010,861 | B2 * | 3/2006 | Nicholson | 33/42 |
| 7,231,720 | B2 * | 6/2007 | Allen | 33/42 |
| 7,370,426 | B2 * | 5/2008 | Choi | 33/42 |
| 8,272,136 | B2 * | 9/2012 | Vogeler et al. | 33/32.1 |
| 2012/0311877 | A1 * | 12/2012 | Manohar | 33/18.1 |

OTHER PUBLICATIONS

V. Ryan, The Mortise Gauge, http://www.technologystudent.com/equip1/mortga1.html, 2003-2009, 3 pages.

International Search Report for application with application No. PCT/IB2011/050047, Dated Mar. 29, 2011, 13 pages.

"Mortise and tenon," accessed at http://web.archive.org/web/20100303042728/http://en.wikipedia.org/wiki/Mortise_and_tenon, last modified on Feb. 22, 2010, pp. 1-4.

* cited by examiner

MARKING GAUGE

CROSS REFERENCE TO RELATED APPLICATIONS

The present Application is the application filing under 35 USC 371 of International Application No. PCT/IB2011/050047, filed on Jan. 6, 2011, and also claims the benefit of Indian Patent Application No. 3533/CHE/2010, filed on Nov. 23, 2010, which is hereby incorporated by reference.

BACKGROUND

Unless otherwise expressly indicated herein, none of the material presented in this section is prior art to the claims of this application and is not admitted to be prior art by having been included herein.

A marking gauge may be used to mark lines for cutting or other operations. In some examples, the marking gauge may include a scribing bar, a stock, and a marking implement. The marking implement may be fixed to the scribing bar. The stock may be adjusted relative to the scribing bar so that the marking implement may be disposed at a desired distance from the stock.

SUMMARY

In one example, a marking gauge is generally described. In some examples, the marking gauge may include a scribing bar and a marking pin disposed at a fixed location in the scribing bar. The marking gauge may include a stock and a bolt. The bolt may extend through the stock and the scribing bar. A nut may be engaged with the bolt. The nut and the bolt may be effective to fasten the stock to the scribing bar.

In one example, a marking gauge is generally described. In some examples, the marking gauge may include a scribing bar and a marking pin disposed at a fixed location in the scribing bar. The marking pin may include a head and a pointed end. A height of the pointed end may be adjustable with respect to the scribing bar. A stock may be effective to be fastened to the scribing bar. A mortise pin may be effective to be fastened to the scribing bar. The mortise pin may include a head and a pointed end. A height of the pointed end of the mortise pin may be adjustable with respect to the scribing bar.

In one example, a marking gauge is generally described. In some examples, the marking gauge may include a scribing bar. The scribing bar may include a width and a length. The scribing bar may include walls defining a first slot extending along the length, and the scribing bar may include walls defining a second slot extending from the first slot to a side of the scribing bar. The marking gauge may include a marking pin disposed at a fixed location in the scribing bar. The marking gauge may include a stock effective to be fastened to the scribing bar. The marking gauge may include a mortise pin. The mortise pin may include a bolt. The bolt of the mortise pin may be effective to extend through the first slot. The mortise pin and the first and second slots may be arranged so that the mortise pin is installable on and removable from the scribing bar through movement of the bolt through the second slot.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE FIGURES

The foregoing and other features of this disclosure will become more fully apparent from the following description and appended claims taken in conjunction with the accompanying drawings. Understanding that these drawings depict only some embodiments in accordance with the disclosure and are therefore not to be considered limiting of its scope, the disclosure will be described with additional specificity and detail by reference to the accompanying drawings in which:

DETAILED DESCRIPTION

Figure 1:
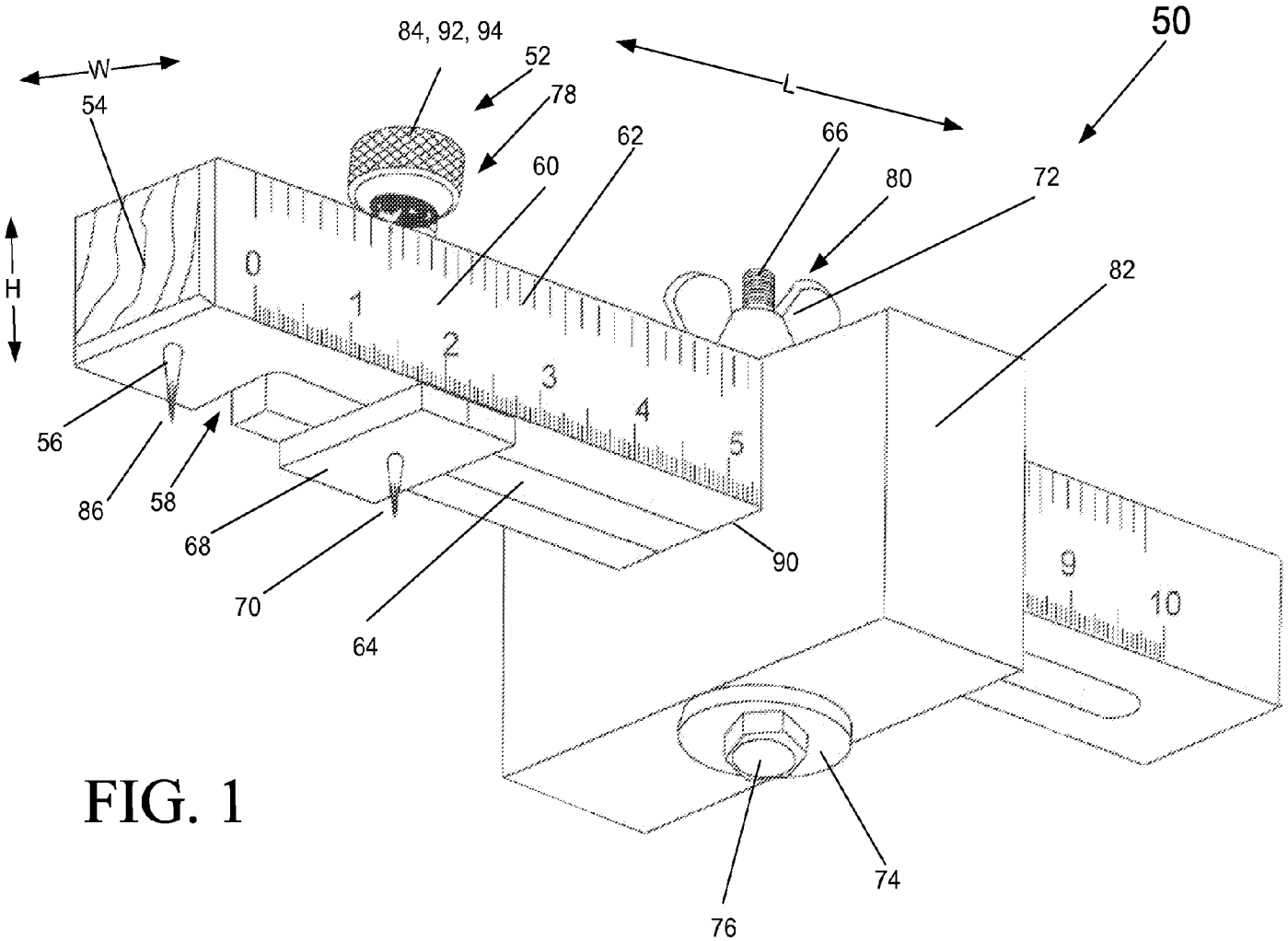
FIG. 1 is a perspective view of an example marking gauge.

In the following detailed description, reference is made to the accompanying drawings which form a part thereof. In the drawings, similar symbols typically identify similar components unless context indicates otherwise. The illustrative embodiments described in the detailed description, drawings and claims are not meant to be limiting. Other embodiments may be utilized and other changes may be made without departing from the spirit or scope of the subject matter presented herein. It will be readily understood that the aspects of the present disclosure as generally described herein and as illustrated in the accompanying figures can be arranged, substituted, combined, separated and/or designed in a wide variety of different configurations all of which are explicitly contemplated herein.

This disclosure is generally drawn, inter alia, to devices, apparatus, systems and methods relating to a marking gauge.

Briefly stated, technologies are generally described for a marking gauge. In some examples, the marking gauge includes a scribing bar and a marking pin disposed at a fixed location in the scribing bar. A bolt may extend through a stock and the scribing bar. A nut may be in contact with the scribing bar and engaged with the bolt. The nut and the bolt may be effective to fasten the stock to the scribing bar. The scribing bar may include walls defining a longitudinally extending slot and the mortise pin may extend through the longitudinally extending slot. A pointed end of the mortise pin and of the marking pin may be adjustable with respect to the scribing bar.

Figure 2:
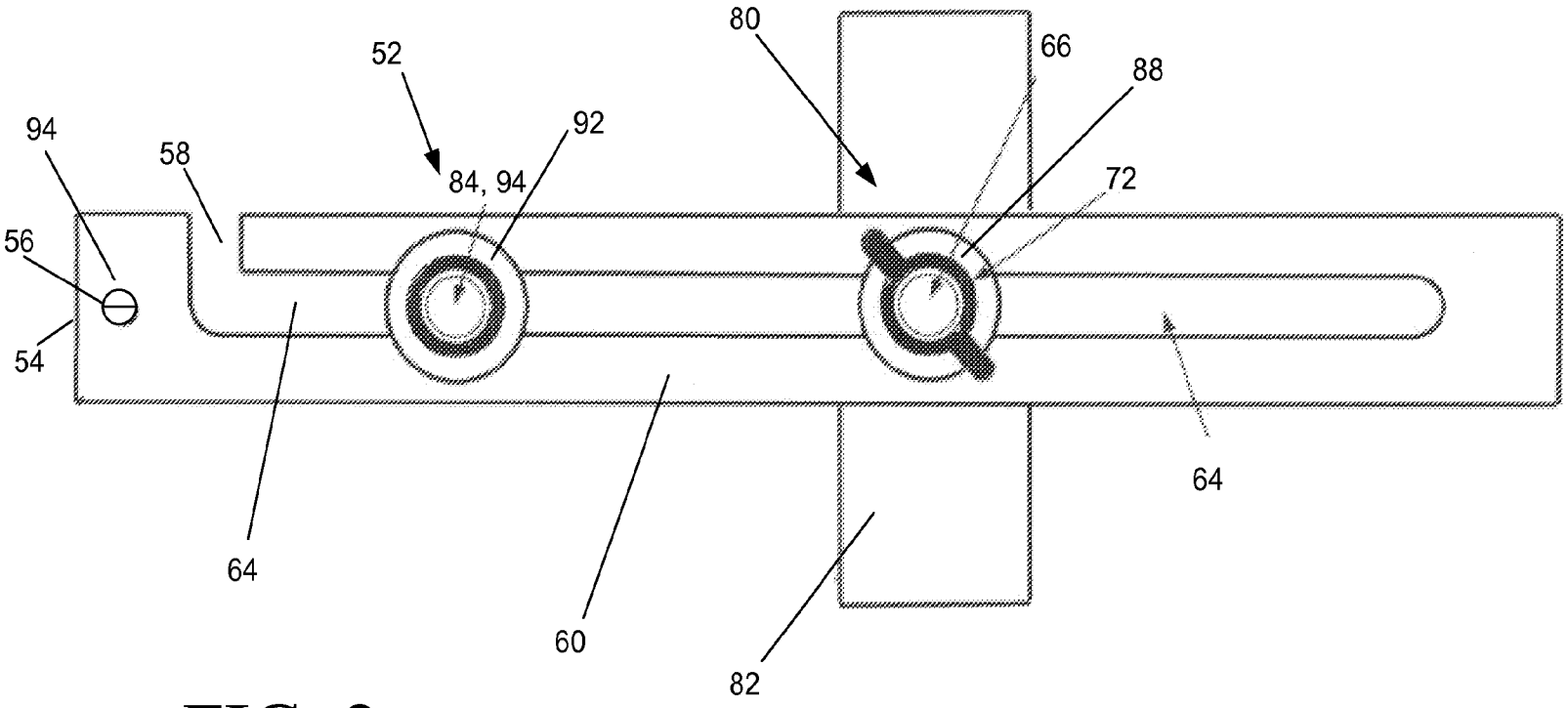
FIG. 2 is a top view of the marking gauge of FIG. 1; all arranged according to at least some embodiments described herein.

FIG. 1 is a perspective view of an example marking and/or mortise gauge arranged according to at least some embodiments described herein. FIG. 2 is top view the marking gauge of FIG. 1.

In some examples, a marking gauge 50 may include a stock 82, a marking pin 56, a mortise pin 52, and/or a scribing bar 60. Stock 82 may be fastened to scribing bar 60 through a bolt 80. Marking pin 56 may be disposed at a fixed location in an end 54 of scribing bar 60. Scribing bar 60 may include walls defining a longitudinal slot 64, and an additional slot 58. Scribing bar 60 may also include ruler demarcations 62 marking different lengths from marking pin 56. Marking gauge 50 may be a rectangular solid with a width W axis, length L axis, and height H axis.

In some examples, scribing bar 60 may be made of a hard, close grained wood and may be 1 inch wide, 1 inch high and 12 inches long. Longitudinal slot 64 may extend along length axis L and may be ¼ inch wide W and 10 inches long L. Additional slot 58 may extend from longitudinal slot 64 to a side of scribing bar 60. Marking pin 56 may be fixed at, for example, ¾ inch from end 54 of scribing bar 60. Marking pin 56 may be a parallel shank sheet metal screw with a slotted head 94.

Stock 82 may have a cross-section defining a recess 90 corresponding to a cross-section of scribing bar 60, and effective to receive scribing bar 60. For example, recess 90 may have a U-shaped cross-section corresponding to a U-shaped cross-section of scribing bar 60, etc. Recess 90 may allow stock 82 to be securely fastened to scribing bar 60 through bolt 80. Bolt 80 may be ¼ inch in diameter and 3 inches in height and may extend through stock 82. Bolt 80 may extend through longitudinal slot 64 and may fasten stock 82 to scribing bar 60 through engagement of a wing nut 72, washer 88, threads 66, nut 76 and washer 74.

As shown in the figures, bolt 80 may be fastened in contact with scribing bar 60 so that stock 82 is at a set or desired distance from marking pin 56 along the length axis L. This means that, in some examples, a distance between wing nut 72 and scribing bar 60 may be about zero inches in height because wing nut 72 may be tightened against threads 66 and contact scribing bar 60 through washer 88. In some examples, a point of application of clamping force from bolt 80 and a point of enforcement of the clamping force at scribing bar 60 may be at the same location. This means the clamping force from bolt 80 may be more effective than other arrangements. Stock 82 may be effectively tightened to scribing bar 60 while limiting lateral movement of stock 82 so that a straight line may be drawn with mortise pin 52. In some examples, stock 82 may be tightened to scribing bar 60 without denting or damaging scribing bar 60 and without requiring an extra cladding on scribing bar 60. As bolt 80 may be threaded through stock 82, bolt 80 may avoid rotating when wing nut 72 is tightened. Nut 72 and bolt 80 may be made of the same or substantially the same material so that a rate of wear may be uniform and clamping efficiency may remain constant.

Mortise pin 52 may include a threaded bolt 78, a head 84, a pointed end 70 and a nut 68. Head 84 may include a knurled nut 94 and a washer 92. Nut 68 may have a rectangular cross-section facilitating secure fastening between mortise pin 52 and scribing bar 60. Bolt 78 may be 2 inches in height and a quarter inch in diameter. Mortise pin 52 may be moveable along longitudinal slot 64 so that mortise pin 52 may be moved and adjusted with respect to marking pin 56. When mortise pin 52 is at a desired location along longitudinal slot 64, bolt 78 may be tightened to scribing bar 62 such as by tightening head 84 with respect to nut 68. The desired location of mortise pin 52 may depend on a width of a mortise to be marked and a distance between pointed end 86 and pointed end 70. Ruler demarcations 62 may be used to assist in determining a distance between each mortise pin 52 and fixed marking pin 56.

Mortise pin 52 can be easily installed on and/or removed from scribing bar 60 through the tightening and/or loosening of bolt 78 and nut 68. For example, mortise pin 52 may be removed from scribing bar 60 so that pointed end 70 may be sharpened. Mortise pin 52 may be installed on scribing bar 60 by inserting bolt 78 through slot 58 and then into longitudinal slot 64 while head 84 remains above scribing bar 60 and nut 68 remains below scribing bar 60. Multiple mortise pins 52 may be installed on scribing bar 60. In another example, marking pin 56 may be used without mortise pin 52. One or more movable mortise pins can be easily installed on and/or removed from scribing bar 60 without requiring disassembly of all of gauge 50. Two or more mortise pins may be installed on scribing bar 60 as desired so that three or more lines may be marked.

A height of pointed end 70 of mortise pin 52, and a height of pointed end 86 of fixed pin 56 may be adjusted so that desired amounts of pointed ends 70, 86 extend from scribing bar 60. For example, fixed marking pin 56 and/or bolt 78 may have an external thread. A height of pointed ends 86 and 70 may be adjusted by rotating pin 56 or bolt 78. Adjustment of pointed ends 86 and 70 allows gauge 50 to be used with woods of varying hardness. For example, softer woods may benefit from pointed ends 86, 70 with larger heights while harder woods may work well with pointed ends 86, 70 of smaller heights. Among other possible uses, a marking gauge in accordance with the disclosure may be used to scribe one or more parallel lines on wooden or metallic blocks prior to chiselling or sawing.

The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, those skilled in the art will recognize that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like include the number recited and refer to ranges which can be subsequently broken down into subranges as discussed above. Finally, as will be understood by one skilled in the art, a range includes each individual member. Thus, for example, a group having 1-3 cells refers to groups having 1, 2, or 3 cells. Similarly, a group having 1-5 cells refers to groups having 1, 2, 3, 4, or 5 cells, and so forth.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

What is claimed is:

1. A marking gauge comprising:

a scribing bar;

a marking pin disposed at a fixed location in the scribing bar;

a stock, wherein the stock defines a recess and a cross-section of the recess corresponds to a cross-section of the scribing bar and the recess is effective to receive the scribing bar;

a bolt, wherein the bolt extends through the stock and the scribing bar; and a nut engaged with the bolt, wherein the nut and the bolt are effective to fasten the stock to the scribing bar.

2. The marking gauge as recited in claim 1, wherein:

the nut and the bolt are effective to fasten the stock to the scribing bar at a distance from the marking pin along an axis;

the scribing bar includes walls defining a longitudinally extending slot extending along the axis; and the bolt extends through the longitudinally extending slot.

3. The marking gauge as recited in claim 2, further comprising a mortise pin, wherein the mortise pin extends through the longitudinally extending slot.

4. The marking gauge as recited in claim 3, further comprising another mortise pin, wherein the another mortise pin extends through the longitudinally extending slot.

5. The marking gauge as recited in claim 3, wherein:

the mortise pin includes a head, a bolt, a pointed end, and a nut; and wherein the bolt of the mortise pin extends through the longitudinal slot.

6. The marking gauge as recited in claim 5, wherein the nut has a rectangular cross-section; and the head is a knurled nut.

7. The marking gauge as recited in claim 5, wherein:

a height of the pointed end is adjustable with respect to the scribing bar; and a height of the marking pin is adjustable with respect to the scribing bar.

8. The marking gauge as recited in claim 1, wherein the scribing bar further comprises ruler demarcations.

9. A marking gauge comprising:

a scribing bar;

a marking pin disposed at a fixed location in the scribing bar, the marking pin including a head and a pointed end, and wherein a height of the pointed end is adjustable with respect to the scribing bar;

a stock effective to be fastened to the scribing bar, wherein the stock defines a recess and a cross-section of the recess corresponds to a cross-section of the scribing bar and the recess is effective to receive the scribing bar; and a mortise pin effective to be fastened to the scribing bar, wherein the mortise pin includes a head and a pointed end, and wherein a height of the pointed end of the mortise pin is adjustable with respect to the scribing bar.

10. The marking gauge as recited in claim 9, wherein:

the stock is effective to be fastened to the scribing bar at a distance from the marking pin along an axis;

the scribing bar includes walls defining a longitudinally extending slot extending along the axis; and the bolt extends through the longitudinally extending slot.

11. The marking gauge as recited in claim 9, wherein:

the mortise pin includes a bolt; and wherein the bolt of the mortise pin extends through the longitudinal slot.

12. The marking gauge as recited in claim 11, further comprising another mortise pin, wherein the another mortise pin extends through the longitudinally extending slot.

13. The marking gauge as recited in claim 9, wherein:

the stock is effective to be fastened to the scribing bar through a bolt, and wherein the bolt extends through the stock and the scribing bar.

14. The marking gauge as recited in claim 13, wherein the nut has a rectangular cross-section; and the head is a knurled nut.

15. A marking gauge comprising:

a scribing bar, wherein the scribing bar includes a width and a length, wherein the scribing bar includes walls defining a first slot extending along the length, and the scribing bar includes walls defining a second slot extending from the first slot to a side of the scribing bar;

a marking pin disposed at a fixed location in the scribing bar, a stock effective to be fastened to the scribing bar;

a mortise pin, wherein the mortise pin includes a bolt, wherein the bolt of the mortise pin is effective to extend through the first slot; and wherein the mortise pin and the first and second slots are arranged so that the mortise pin is installable on and removable from the scribing bar through movement of the bolt through the second slot.

16. The marking gauge as recited in claim 15, further comprising:

another mortise pin in the first slot.

17. The marking gauge as recited in claim 15, wherein:

the marking pin includes a pointed end, and wherein a height of the pointed end is adjustable with respect to the scribing bar;

the mortise pin includes a pointed end, and wherein a height of the pointed end of the mortise pin is adjustable with respect to the scribing bar.

18. The marking gauge as recited in claim 15, wherein:

the stock defines a recess; and a cross-section of the recess corresponds to a cross-section of the scribing bar.

19. A marking gauge comprising:

a scribing bar, wherein the scribing bar includes a width and a length, wherein the scribing bar includes walls defining a first slot extending along the length, and the scribing bar includes walls defining a second slot extending from the first slot to a side of the scribing bar;

a marking pin disposed at a fixed location in the scribing bar, the marking pin including a head and a pointed end, and wherein a height of the pointed end is adjustable with respect to the scribing bar;

a stock effective to be fastened to the scribing bar;

a bolt, wherein the bolt extends through the stock and the first slot of the scribing bar;

a nut engaged with the bolt, wherein the nut and the bolt are effective to fasten the stock to the scribing bar;

a mortise pin effective to be fastened to the scribing bar, wherein the mortise pin includes a head and a pointed end, and wherein a height of the pointed end of the mortise pin is adjustable with respect to the scribing bar; and wherein the mortise pin and the first and second slots are arranged so that the mortise pin is installable on and removable from the scribing bar through movement of the bolt through the second slot.

* * * * *